US005184140A

United States Patent [19]

Hariu et al.

[11] Patent Number: 5,184,140

[45] Date of Patent: Feb. 2, 1993

[54] ANTENNA SYSTEM

[75] Inventors: Kenichi Hariu; Isamu Chiba; Seiji Mano, all of Kamakura, Japan

[73] Assignee: Mitsubishi Denki Kabushiki Kaisha, Japan

[21] Appl. No.: 660,692

[22] Filed: Feb. 25, 1991

[30] Foreign Application Priority Data

Feb. 26, 1990 [JP] Japan ..... 2-44721

[51] Int. Cl.[5] ..... H01Q 3/22; H01Q 3/24; H01Q 3/26

[52] U.S. Cl. ..... 342/372

[58] Field of Search ..... 342/372, 378, 379, 380, 342/154

[56] References Cited

U.S. PATENT DOCUMENTS

| | | | |
|---|---|---|---|
| 4,217,586 | 8/1980 | McGuffin . | |
| 4,313,116 | 1/1982 | Powell et al. . | |
| 4,338,605 | 7/1982 | Mims . | |
| 4,752,969 | 6/1988 | Rilling | 342/380 |
| 4,983,981 | 1/1991 | Feldman | 342/372 |

OTHER PUBLICATIONS

Klein, C. A., "Design of Shaped-Beam Antennas Through Minimax Gain Optimization", *IEEE Transactions on Antennas and Propagation*, vol. AP-32, No. 9, Sep. 1984, pp. 963—968.

*Primary Examiner*—Theodore M. Blum
*Attorney, Agent, or Firm*—Wolf, Greenfield & Sacks

[57] ABSTRACT

Disclosed herein is an antenna system comprising a plurality of element antennas, a plurality of variable phase shifters and a plurality of variable amplitude type devices connected to the plurality of element antennas respectively, and an arithmetic unit used to perform the arithmetical operation of the excitation amplitude and phase for exciting each of the plurality of element antennas. The arithmetic unit includes the four means and performs the arithmetical operation of the excitation amplitude and phase used to define a desired radiation pattern composed by each of the element antennas with respect to a preset allowable variation width D of the excitation amplitude. Since the arithmetic unit serves to fix the excitation amplitude and perform the arithmetical operation of the excitation phase separately, the antenna system capable of performing the arithmetical operation of the excitation amplitude and phase for obtaining a desired radiation pattern with respect to the preset allowable variation width D of the excitation amplitude, and obtaining a desired radiation pattern even when the allowable variation width D of the excitation amplitude is given, can be realized.

13 Claims, 6 Drawing Sheets

ANTENNA SYSTEM

BACKGROUND OF THE INVENTION

Field of the Invention

The present invention relates to an antenna system which performs the composition of directional properties of each antenna where an allowable variation width D of the excitation amplitude is given.

Discussion of Background

A method of composing directional properties of each antenna to define a desired radiation pattern in accordance with a flowchart shown in FIG. 5 is disclosed, for example, in the article "Design of Shaped-Beam Antennas Through Minimax Gain Optimization" by Charles A. Klein, IEEE Transactions on Antennas and Propagation, Vol. AP-32, No. 9, Sep. 1984.

A description will now be made of the procedure for composing the directional properties of the antennas employed in the conventional example in accordance with the flowchart shown in FIG. 5.

The total number J of evaluation points and the total number I of element antennas are inputted in Steps S1 and S2, respectively. The desired antenna gain $G_{oj}$, the patterns of array elements $P_{ij}$, a weighting factor $W_j$ and the initial amplitude and phase $A_i$ (hereinafter called merely "excitation amplitude and phase") of the excitation currents or voltages are inputted in Steps S3, S4, S5, S6, respectively, with respect to i=1 to I and j=1 to J. Here, each of both the initial excitation amplitude and phase $A_i$ and the patterns of the array elements $P_{ij}$ is the complex number. The antenna gain $G_j$ is calculated in Step S7 with respect to all the directions of antennas to be observed, i.e., searched (evaluation points) j 32 1 to J. The antenna gain $G_j$ is given by the following equation:

$$G_j = \sum_{i=1}^{I} (A_i \cdot P_{ij})^* \cdot (A_i \cdot P_{ij})/(A_i^* \cdot A_i)$$

where the asterisk * represents the complex conjugate

The, one antenna searching direction for bringing the difference between the antenna gain $G_j$ obtained in Step S7 and the desired antenna gain $G_{oj}$ into the maximum is selected in Step S8. The combination or set of values of $A_i$ (i=1 to I) which provides a solution for minimizing an evaluation function F represented by the following equation is determined in Step S9 with respect to the antenna searching direction selected in Step S8. Incidentally, the non-linear programming or the like is used to minimize the evaluation function F, $$F = W_j \, |G_j - G_{oj}|^2$$

The antenna gain $G_j$ (i=1 to J) is calculated in Step S10 with respect to the set of the values of $A_i$ (i=1 to I) which provides the solution determined in Step S9 in accordance with the following equation:

$$G_j = \sum_{i=1}^{I} (A_i \cdot P_{ij})^* \cdot (A_i \cdot P_{ij})/(A_i^* \cdot A_i)$$

where the asterisk * represents the complex conjugate

After having finished the above procedure, it is determined in step S11 whether or not all $G_j$ exceeds the desired antenna gain $G_{oj}$. If it is determined that $G_j$ has exceeded the desired antenna gain $G_{oj}$, then the excitation amplitude and phase $A_i$ determined in Step S9 are regarded as the desired excitation amplitude and phase, thereby terminating the arithmetical operation of the excitation amplitude and phase. If it is judged to be negative, the routine procedure returns to Step S6. Then, the arithmetical operation of the excitation amplitude and phase is repeatedly performed using the set of the values of $A_i$ (i=1 to I) which provides the solution obtained in Step S9, and a judgment on the result of its arithmetical operation is made.

The composition of the directional properties of the conventional antennas is carried out provided that the excitation amplitude and phase $A_i$ obtained by the arithmetical operation based on such procedure as described above are taken as the desired excitation amplitude and phase. Therefore, when the allowable variation width D of the excitation amplitude is established, there is a problem that the calculated excitation amplitude does not fall within the range of its allowable variation width D. In some instances, for example, there is a case where the allowable variation width D of the excitation amplitude is restricted to simplify a feeder circuit for an active phased array antenna. Thus, the method of composing the directional properties of the antennas in accordance with the arithmetical operation based on the above-described procedure cannot determine the excitation amplitude and phase for obtaining a desired radiation pattern.

SUMMARY OF THE INVENTION

With the foregoing problem in view, it is an object of the present invention to provide an antenna system which can obtain a desired radiation pattern even when the allowable variation width D of the excitation amplitude is given.

According to one aspect of this invention, there is provided an antenna system which comprises:

a plurality of element antennas;

a plurality of variable phase shifters and a plurality of variable amplitude type devices connected to the plurality of element antennas respectively; and an arithmetic unit used to perform the arithmetical operation of the excitation amplitude and phase for exciting each of the plurality of element antennas, said arithmetic unit including respective means for determining the excitation amplitude and phase used to obtain a desired radiation pattern without limitations on both the excitation amplitude and phase; standardizing the excitation amplitude with the maximum value M and replacing all the values of the excitation amplitude, which are defined in such a manner that the result thus standardized is below the allowable variation width D of the excitation amplitude, by M.D; and then fixing all the excitation amplitude, thereby performing the arithmetical operation of the excitation phase used to define the desired radiation pattern.

According to the present invention, the arithmetic unit comprises mean for representing the evaluation function F in the form of the sum of the following two equation:

$$F = \sum_{j=1}^{J} W_j \, |G_j - G_{oj}|^2$$

$$J = 1 \text{ to } J$$

thereby to determine the set of the values of the excitation amplitude and phase $A_i$ (i=1 to I) which provides a solution for minimizing the evaluation function F; means for standardizing the above excitation amplitude $a_i$ with the maximum value M provided that $a_i=|A_i|$ and M=Max. $a_i$ (i=1 to I) in the set of the values of $A_i$ obtained from the above and for replacing the values of the excitation amplitude $a_i$, which are defined in such a manner that the value thus standardized is below the allowable variation width D of the excitation amplitude, by M.D; and means for fixing all of the excitation amplitude $a_i$ (i=1 to I) obtained in the above so as to determine the set of the values of the excitation phase $P_i$ (i=1 to I) which provides a solution for minimizing the evaluation function F. This arithmetic unit serves to fix all the excitation amplitude and perform the arithmetical operation of the excitation phase for obtaining a desired radiation pattern. Further, the arithmetic unit includes means for calculating the antenna gain $G_j$ (j=1 to J) with respect to the set of the values of $A_i$ (i=1 to I) obtained from $a_i$ and $P_i$ determined in the above, in accordance with the following equation:

$$G_j = \sum_{i=1}^{I} (A_i \cdot P_{ij})^* \cdot (A_i \cdot P_{ij})/(A_i^* \cdot A_i)$$

where the asterisk * represents the complex conjugate; means for regarding $a_i$ and $p_i$ (i=1 to I) thus obtained as being the amplitude and phase respectively, if all the antenna gains $G_j$ obtained from the above equation exceed a desired antenna gain $G_{oj}$ (j=1 to J), thereby terminating the arithmetical operation of the excitation amplitude and phase and for making a judgment on an advance to the following step if they do no exceed the desired antenna gain $G_{oj}$; and means for making a judgment as to the magnitude between $G_j$ and $G_{oj}$ in response to the determination that all the $G_j$ has not exceeded the desired antenna gain $G_{oj}$, thus setting in such a manner that if $G_j \geqq G_{oj}$, then $W_j$ is equal to 0 (i.e., $W_j=0$) and if $G_j<G_{oj}$, then $W_j$ is equal to 1 (i.e., $W_j=1$ (j=1 to J)), and for utilizing $A_i$ (i=1 to I) obtained in the above as the initial excitation amplitude and phase and then returning again to the previous Step so as to execute the arithmetical operation of the excitation amplitude and phase. The arithmetic unit also performs the arithmetical operation of the excitation amplitude and phase used to obtain a desired radiation pattern with respect to the present allowable variation width D of the excitation amplitude.

BRIEF DESCRIPTION OF THE DRAWINGS

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENTS

A preferred embodiment of the present invention will hereinafter be described with reference to the accompanying drawings.

Figure 1:
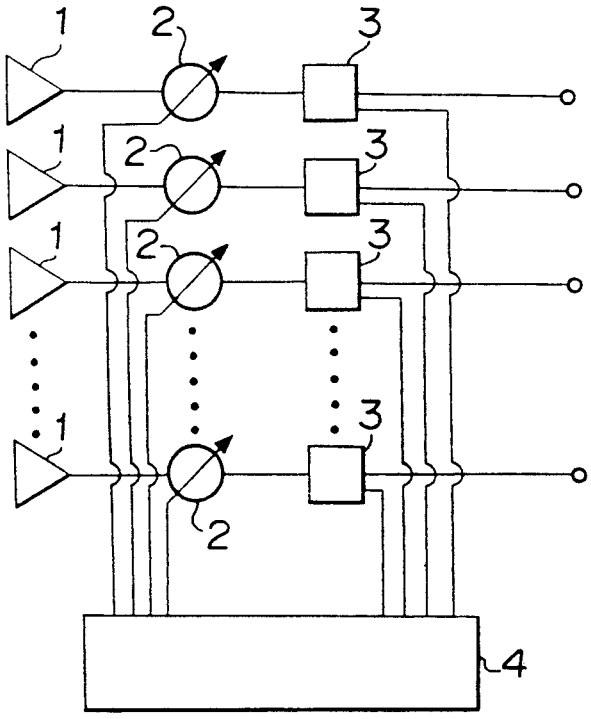
FIG. 1 is a diagram showing the structure of an antenna system according to one embodiment of the present invention.

FIG. 1 is a diagram showing the structure of an antenna system according to one embodiment of the present invention. In the same drawing, there are shown element antennas 1, variable phase shifters 2 connected to the element antennas 1 respectively, variable amplitude type devices 3 connected to the element antennas 1 respectively, an arithmetic unit 4 for performing the arithmetical operation of the excitation amplitude and phase used for the excitation of each of the element antennas 1. Here, the arithmetic unit 4 has means of (a) through (g) to be described below.

(a) Means for calculating the antenna gain $G_j$ (j=1 to J) in accordance with the following equation:

$$G_j = \sum_{i=1}^{I} (A_i \cdot P_{ij})^* \cdot (A_i \cdot P_{ij})/(A_i^* \cdot A_i)$$

where J=total number of inputted evaluation points
I=total number of elements antennas
$P_{ij}$=patterns of array elements
$A_i$=initial excitation amplitude and phase
i=1 to I
j=1 to J
*=complex conjugate (b) Means for determining the combination or set of values of $A_i$ (i=1 to I) which provides a solution for minimizing an evaluation function F represented by the following equation:

$$F = \sum_{j=1}^{J} W_j \, |G_j - G_{oj}|^2$$

where
$G_j$ (j=1 to J)=antenna gain obtained in accordance with the equation in said means (a)
$G_{oj}$=inputted desired antenna gain
Wj=weighting factor
j=1 to J (c) Means for standardizing the excitation amplitude $a_i$ with the maximum value M provided that $a_i=|A_i|$, M=Max. $a_i$ (i=1 to I) in the set of the values of $A_i$ obtained in the above so as to replace the value of the excitation amplitude $a_i$, which is defined in such a manner that the value thus standardized is below the allowable variation width D of the excitation amplitude, by M.D.

(d) Means for fixing all the excitation amplitude $a_i$ (i=1 to I) so as to determine the set of the excitation phase $P_i$ (i=1 to I), which provides a solution for minimizing the evaluation function F represented by the following equation:

$$F = \sum_{j=1}^{J} W_j \, |G_j - G_{oj}|^2$$

where $p_i = \tan^{-1} I_A i / R_A i$ $R_A i$ = real part of $A_i$ $I_A i$ = imaginary part of $A_i$ (e) Means for calculating $G_j$ (j=1 to J) with respect to the set of the values of $A_i$ (i=1 to I) obtained from $a_i$ and $p_i$ determined in the above, in accordance with the following equation:

$$G_j = \sum_{i=1}^{I} (A_i \cdot P_{ij})^* \cdot (A_i \cdot P_{ij}) / (A_i^* \cdot A_i)$$

where the asterisk * represents the complex conjugate (f) Means for regarding $a_i$, $p_i$ (l=1 to I) thus obtained as being desired excitation amplitude and phase, respectively, if all $G_j$ thus obtained exceeds a desired antenna gain $G_{oj}$ (j=1 to J), thereby terminating the arithmetical operation of the excitation amplitude and phase, and for making a judgment on an advance to the following step if it does not exceed the antenna gain $G_{oj}$.

(g) Means for making a judgment as to whether or not $G_j$ is greater than $G_{oj}$ in response to the determination that all the $G_j$ has not exceeded the desired antenna gain $G_{oj}$, thereby setting in such a manner that if $G_j \geqq G_{oj}$, then $W_j = 0$, and if $G_{j<Goj}$, then $W_j = 1$ (j=1 to J), and for utilizing $A_i$ (i=1 to I) obtained by the above means (b) as the initial excitation amplitude and phase and then returning again to the above means (a) so as to execute the arithmetical operation of the excitation amplitude and phase.

A description will now be made of the operation of the antenna system according to the present invention, laying stress on the operation of the arithmetic unit 4.

Figure 2A:
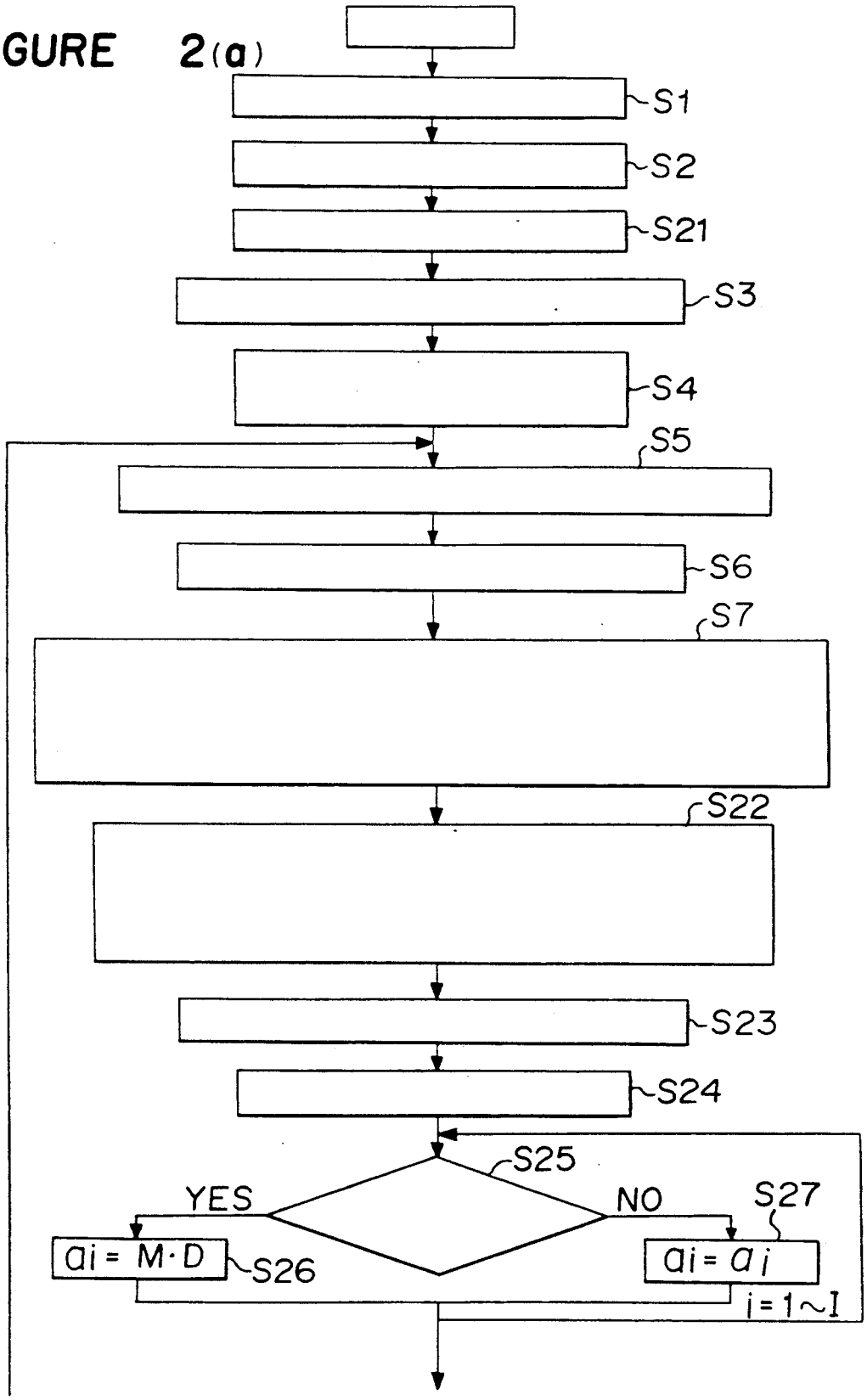
FIG. 2 is a flowchart for describing the operation of an arithmetic unit employed in the antenna system according to the present invention.
Figure 2B:
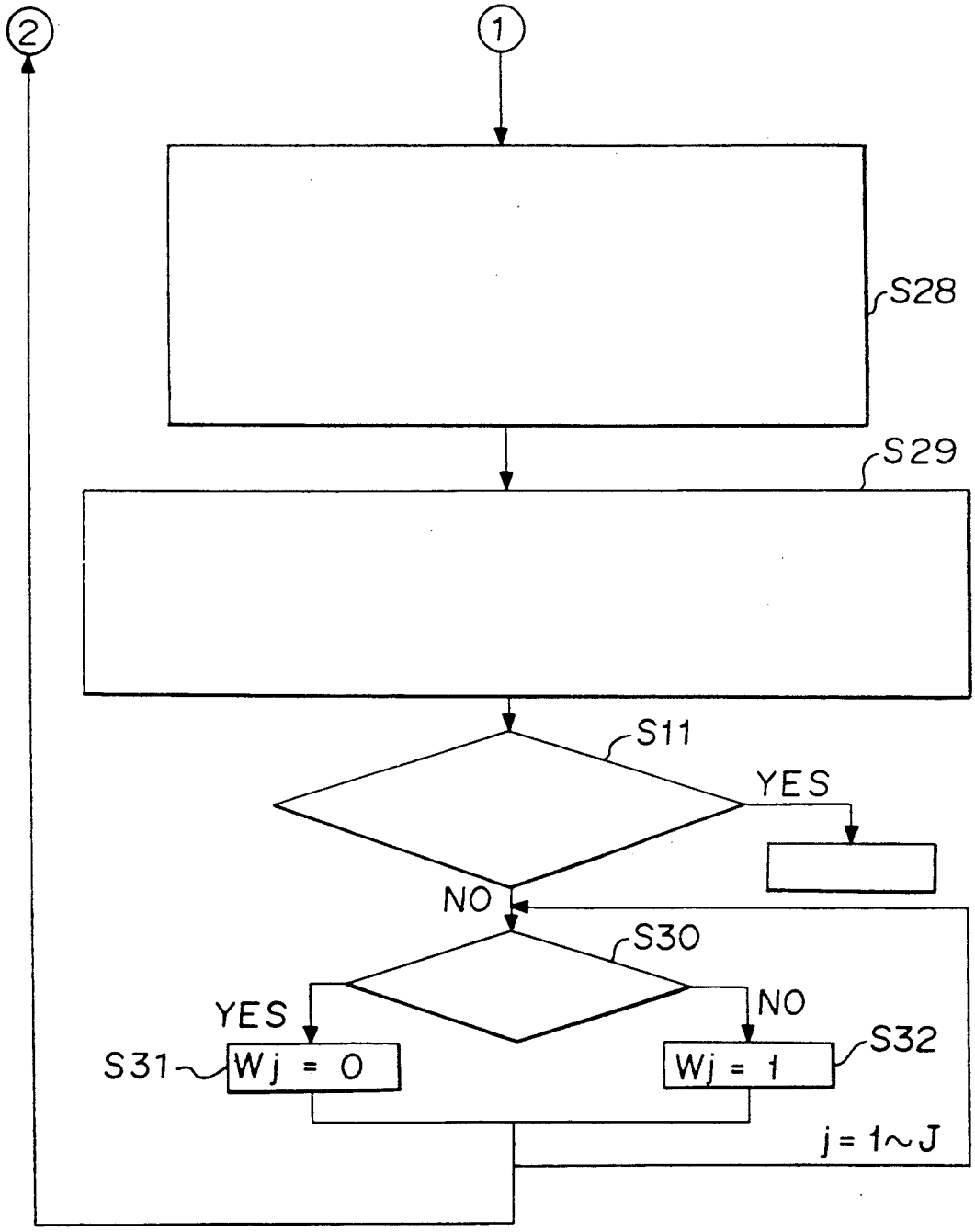

FIG. 2 is a flowchart for describing the operation of the arithmetic unit 4. Its description will be made below in accordance with the flowchart.

The total number J of the evaluation points, the total number I of the element antennas, and the allowable variation width D of the excitation amplitude are inputted in Steps S1, S2, S21, respectively. The desired antenna gain $G_{oj}$, the patterns of the array elements $P_{ij}$, the weighting factor $W_j$, the initial excitation amplitude and phase $A_i$ are inputted in Steps S3, S4, S5, S6, respectively, with respect to i=1 to I and j=1 to J. Here, each of both the initial excitation amplitude and phase $A_i$ and the patterns of the array elements $P_{ij}$ is the complex number. The antenna gain $G_j$ is calculated in Step S7 with respect to all the directions of the antennas to be observed or searched (evaluation points) i=1 to J. The antenna gain $G_j$ is given by the following equation:

$$G_j = \sum_{i=1}^{I} (A_i \cdot P_{ij})^* \cdot (A_i \cdot P_{ij}) / (A_i^* \cdot A_i)$$

where the asterisk * represents the complex conjugate

Then, the set of the values of $A_i$ (i=1 to I) which provides a solution for minimizing the evaluation function F is determined in Step S22 with respect to the above antenna gain $G_j$. The evaluation function F is given by the following equation:

$$F = \sum_{j=1}^{J} W_j \, |G_j - G_{oj}|^2$$

In Steps S23 and S24, the routine procedure is executed such that the excitation amplitude $a_i$ is equal to $|A_i|$ (i=1 to I) (i.e., $a_i = |A_i|$), and M is equal to Max. $a_i$ (i.e., M=Max. $a_i$) (i=1 to I) in the set of the values of $A_i$ (i=1 to I) obtained in Step S22. It is determined in Step S25 whether the above $a_i$ corresponds to the maximum value M or it is below the allowable variation width D. If it is determined that the result of the former is of no, then the above $a_i$ is standardized by the maximum value M in Step S27. If it is judged that the result of the latter is of yes, then all the values of the excitation amplitude $a_i$, which are defined in such a manner that the value thus standardized is below the allowable variation width D of the excitation amplitude are replaced by the M.D in Step S26. All the values of the excitation amplitude $a_i$ are fixed and the set of the values of the excitation phase $p_i$ (i=1 to I), which provides a solution for minimizing the evaluation function F, is determined in Step S28. The evaluation function F is given by the following equation:

$$F = \sum_{j=1}^{J} W_j \, |G_j - G_{oj}|^2$$

where $p_i = \tan^{-} I_A I / R_A i$ $R_A i$ = real part of $A_i$ $I_A i$ = imaginary part of $A_i$ The antenna gain $G_j$ (j=1 to J) is calculated in Step S29 with respect to the set of the values of $A_i$ (i=1 to I) obtained from $a_i$ and pi determined in the above in accordance with the following equation:

$$G_j = \sum_{i=1}^{I} (A_i \cdot P_{ij})^* \cdot (A_i \cdot P_{ij}) / (A_i^* \cdot A_i)$$

where the asterisk * represents the complex conjugate

It is determined in Step S11 that if all the antenna gains $G_j$ obtained from the above equation exceed a desired antenna gain $G_{oj}$ (j=1 to J), then the arithmetical operation of the excitation amplitude and phase is terminated with $a_i$ and $p_i$ (i=1 to I) thus obtained being taken as the desired excitation amplitude and phase respectively, and if not so, the routine procedure advances to the following step. Further, it is determined in Step S30 whether or not $G_j$ exceeds the desired antenna gain $G_{oj}$ in response to the determination that all $G_j$ has not exceeded the desired antenna gain $G_{oj}$. If $G_j \geqq G_{oj}$, then $W_j$ is set to be equal to 0 in Step S31. If $G_j < G_{oj}$, then $W_j$ is set to be equal to 1 (j=1 to J) in Step S32. In addition, $A_i$ (i=1 to I) thus obtained is then used as the initial excitation amplitude and phase, and the routine procedure returns again to Step S5 from which the arithmetical operation of the excitation amplitude and phase is repeatedly executed.

As described above, the arithmetic unit 4 performs the arithmetical operation of the excitation amplitude and phase which are used to define a desired radiation pattern composed by each of the element antennas with respect to the preset allowable variation width D of the excitation amplitude. Then, the quantity of a shift in phase of each of the variable phase shifters 2 connected to the element antennas 1 respectively, and the amplitude of the output from each of the variable amplitude type devices 3 are set based on the result of arithmetical operation of the excitation amplitude and phase in the arithmetic unit 4. As a consequence, each of the plural element antennas 1 is excited.

Then, the above-described embodiment and the conventional example show the result obtained by representing, as the amount of attenuation of a desired antenna gain, the deterioration in a desired radiation pattern out of radiation patterns obtained with respect to the preset allowable variation width D of the excitation amplitude and making a comparison between the two. The present embodiment shows a desired radiation pattern which increases the antenna gain in a direction in which a plurality of antennas are to be searched, and a radiation pattern which decreases the antenna gain in a direction in which a plurality of other antennas are to be searched. This is a result realized by the combination of the above-described embodiment and the conventional example.

Figure 3:
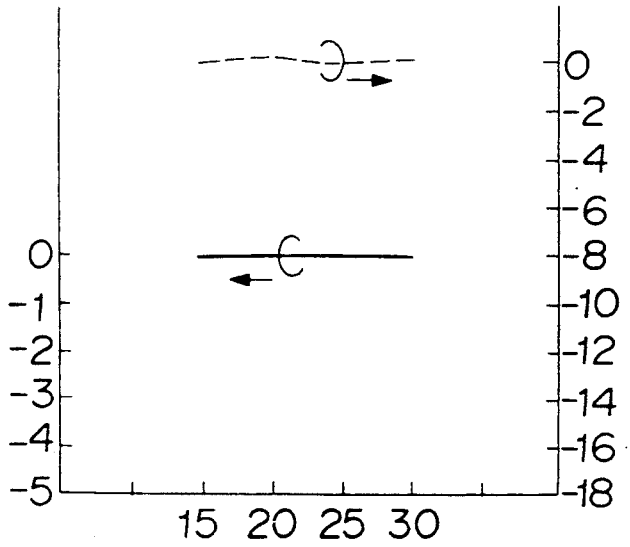
FIG. 3 is a characteristic diagram for describing the deterioration in a radiation pattern obtained from said one embodiment with respect to an allowable variation width D of the excitation amplitude.

FIG. 3 is a characteristic diagram showing the deterioration of a radiation pattern with respect to the allowable variation width D of the excitation amplitude, which is obtained by the above-described embodiment. In the same drawing, the solid line represents the minimum gain at a region in which the antenna gain is increased, and the broken line shows the maximum gain at a region in which the antenna gain is decreased. It is understood from FIG. 3 that the amount of attenuation of the antenna gain is approximately 0 dB and a desired radiation pattern can be obtained even when the allowable variation width D of the excitation amplitude is in a restrained state.

Figure 4:
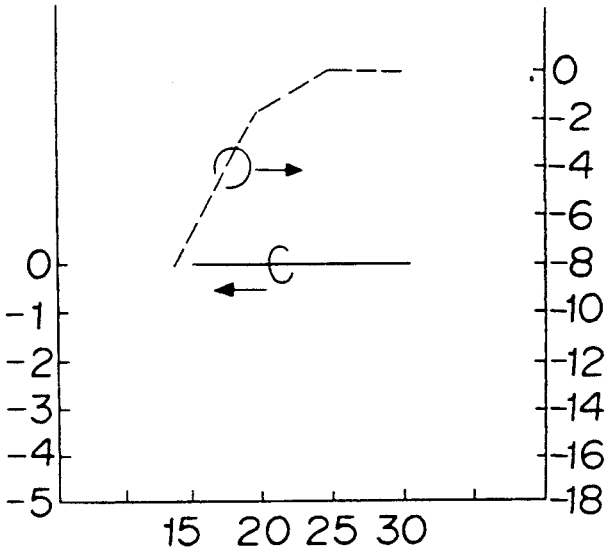
FIG. 4 is a characteristic diagram for describing the deterioration in a radiation pattern obtained from a conventional example with respect to an allowable variation width D of the excitation amplitude.
Figure 5:
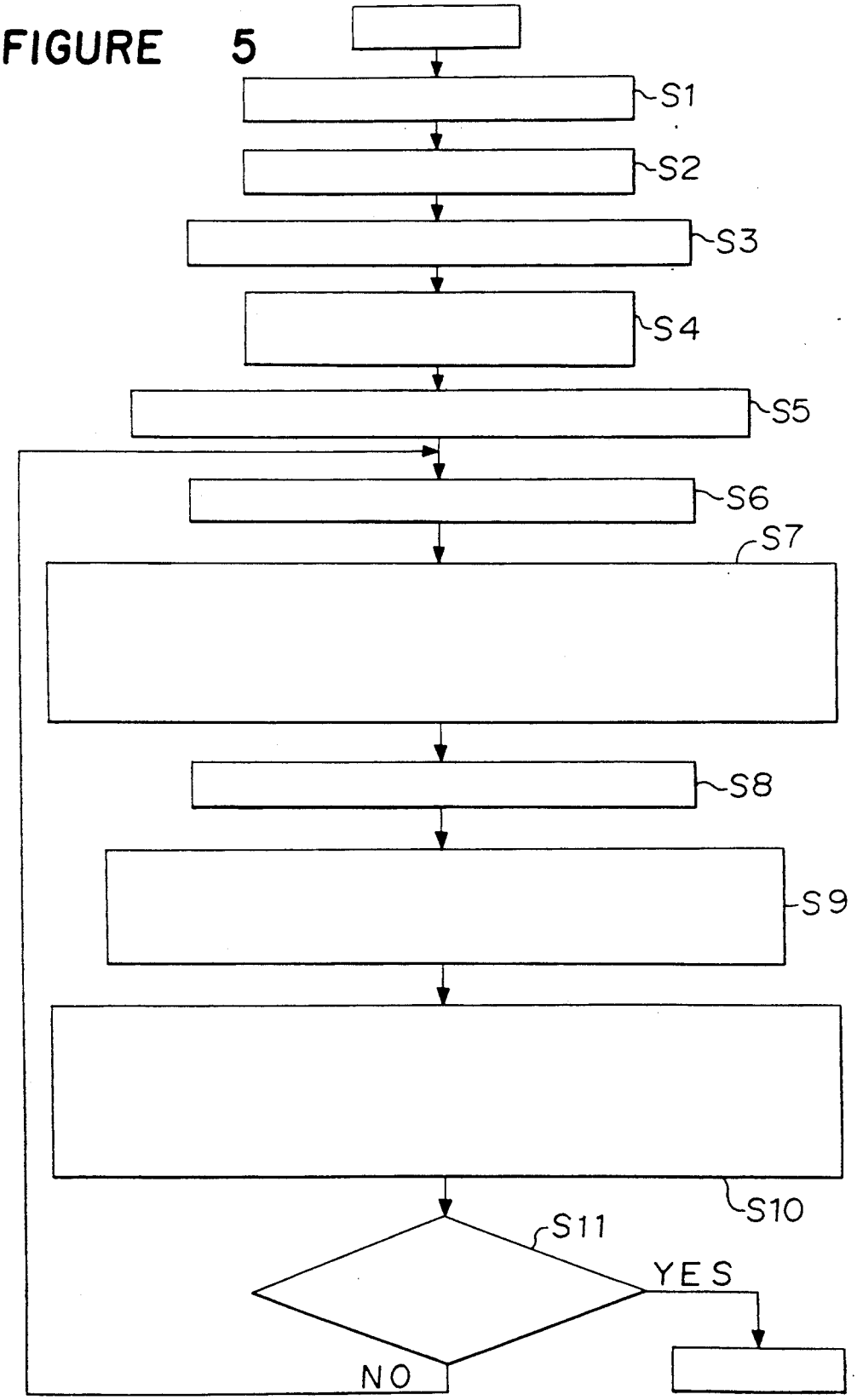
FIG. 5 is a flowchart for describing the sequence procedure used to perform the composition of directional properties of antennas employed in the conventional example.

In addition, FIG. 4 is a characteristic diagram showing the deterioration in a radiation pattern with respect to the allowable variation width D of the excitation amplitude, which pattern is obtained from the above conventional example. Similarly to FIG. 3, the solid line represents the minimum gain at a region in which the antenna gain is increased, whereas the broken line shows the maximum gain at a region in which the antenna gain is decreased. In this case, as for the excitation amplitude, the excitation amplitude obtained from the arithmetical operation effected in the conventional example is normalized by the maximum value M. As a result, the values of the excitation amplitude less than the allowable variation width D of the excitation amplitude are all replaced by M.D. As for the excitation phase, the excitation phase obtained from the arithmetical operation performed in the conventional example is used as is. It is understood from FIG. 4 that the amount of attenuation of the antenna gain at the region in which it is reduced becomes larger as the allowable variation width D of the excitation amplitude decreases, and the radiation pattern is deteriorated when the limitations on the excitation amplitude is made in the conventional example. Thus, in accordance with the present invention, it is feasible to realize the antenna system which can perform the arithmetical operation of the excitation amplitude and phase for obtaining a desired radiation pattern with respect to the preset allowable variation width D of the excitation amplitude, and obtain a desired radiation pattern even when the allowable variation width D of the excitation amplitude is given.

Having now fully described the invention, it will be apparent to those skilled in the art that many changes and modifications can be made without departing from the spirit or scope of the invention as set forth herein.

What is claimed is:

1. An antenna system comprising:

a plurality of element antennas;

a plurality of variable phase shifters and a plurality of variable amplitude type devices connected to said plurality of element antennas respectively, and an arithmetic unit used to perform an arithmetical operation of the excitation amplitude and phase for exciting each of said plurality of element antennas, said arithmetic unit including the following means (a) thorough (g) and performing the arithmetical operation of the excitation amplitude and phase used to define a desired radiation pattern composed by each of said plurality of element antennas with respect to a preset allowable variation width D of the excitation amplitude;

(a) means for calculating the antenna gain $G_j$ (j=1 to J) in accordance with the following equation:

$$G_j = \sum_{i=1}^{I} (A_i \cdot P_{ij})^* \cdot (A_i \cdot P_{ij})/(A_i^* \cdot A_i)$$

wherein

J=total number of inputted evaluation points

I=total number of elements antennas $P_{ij}$=patterns of array elements $A_i$=initial excitation amplitude and phase i=1 to I j=1 to J

*=complex conjugate (b) means for determining the combination or set of values of $A_i$(i=1 to I) which provides a solution for minimizing an evaluation function F represented by the following equation:

$$F = \sum_{j=1}^{J} W_j \, |G_j - G_{oj}|^2$$

where $G_j$(j=1 to J)=antenna gain obtained in accordance with the equation represented by said means (a)

$G_{oj}$=inputted desired antenna gain $W_j$=weighting factor j=1 to J (c) means for standardizing the excitation amplitude $a_i$ with the maximum value M provided that $a_i = -|A_i|$. M=Max. $a_i$; (i=1 to I) in the set of the values of $A_i$ obtained from the above means (b) to thereby replace the value of the excitation amplitude $a_i$, which is defined to make the value thus standardized below the allowable variation width D of the excitation amplitude, by M.D.

(d) means for fixing all the excitation amplitude $a_i$ (i=1 to I) obtained from the above so as to determine the set of the excitation phase $p_i$ (i=1 to I), which provides a solution for minimizing the evaluation function F represented by the following equation:

$$F = \sum_{j=1}^{J} W_j \, |G_j - G_{oj}|^2$$

where $p_i = \tan^{-1} I_A i / R_A i$ $R_A i$ = real part of $A_i$ $I_A i$ = imaginary part of $A_i$ (e) means for calculating $G_j$ (j=1 to J) with respect to the set of the values of $A_i$ (i=1 to I) obtained from $a_i$ and $p_i$ determined from the above, in accordance with the following equation:

$$G_j = \sum_{i=1}^{I} (A_i \cdot P_{ij})^* \cdot (A_i \cdot P_{ij})/(A_i^* \cdot A_i)$$

where the asterisk * represents the complex conjugate (f) means for regarding $a_i$, $p_i$ (i=1 to I) thus obtained as being desired excitation amplitude and phase, respectively, if all $G_j$ obtained from the equation in said means (e) exceeds a desired antenna gain $G_{oj}$ (j=1 to J), thereby terminating the arithmetical operation of the excitation amplitude and phase, and for making a judgment on an advance to the following step if it is below the desired antenna gain $G_{oj}$.

(g) means for making a judgment as to whether or not $G_j$ is greater than $G_{oj}$ in response to the determination that all $G_j$ has been below the desired antenna gain $G_{oj}$, thus setting in such a manner that if $G_j \geqq G_{oj}$, then $W_j = 0$ and if $G_j < G_{oj}$, then $W_j = 1$ (j=1 to J), and for utilizing $A_i$ (i=1 to I) obtained from the above means (b) as the initial excitation amplitude and phase and then returning again to the above means (a) so as to execute the arithmetical operation of the excitation amplitude and phase.

2. An antenna system, comprising:

a plurality of element antennas;

a like plurality of controllably variable phase shift means, each connected to a respective one of said element antennas, for respectively controlling excitation phase for said element antennas;

a like plurality of controllably variable amplitude controlling means, each connected to a respective one of said variable phase shifters, for respectively controlling excitation amplitude for said element antennas; and control means connected to control each of said variable phase shift means and to control each of said variable phase shift means and to control each of said variable amplitude controlling means, said control means including means for determining, within an allowable variation width of the excitation amplitude, the excitation amplitude and the excitation phase for excitation of each of said element antennas, and said control means further including means responsive to said determining means for variously individually controlling said plurality of variable phase shift means and said plurality of variable amplitude setting means in accordance with the excitation amplitudes and excitation phases determined by said determining means.

3. An antenna system as recited in claim 2 wherein said means for determining comprises an arithmetic unit that determines the excitation amplitude and the excitation phase so that the antenna gain $G_j$ (j=1 to J) (J is the total number of evaluation points) at the jth evaluation point approaches a desired antenna gain $G_{oj}$ by performing an arithmetical operation so that said antenna gain $G_j$ (j=1 to J) at the jth evaluation point becomes closer to the desired gain $G_{oj}$ by only the effect of the excitation phase; keeps said excitation amplitude in the allowable variation width; and fixes said excitation amplitude in the allowable variation width; and fixes said excitation amplitude kept in said allowable variation width.

4. An antenna system as cited in claim 2 wherein said means for determining comprises:

first means for determining the excitation amplitude and the excitation phase so that the antenna gain $G_j$ (j=1 to J) (J is the total number of evaluation points) at the jth evaluation point approaches a desired antenna gain $G_{oj}$;

means for establishing the allowable variation width of the excitation amplitude;

second means responsive to said establishing means for determining whether the excitation amplitude falls within the allowable variation width; and means responsive to said second determining means for again determining the excitation amplitude and the excitation phase such that the antenna gain $G_j$ (j=1 to J) at the jth evaluation point becomes closer to the desired gain $G_{oj}$ by only the effect of the excitation phase.

5. An antenna system as recited in claim 2, further comprising:

means, connected to said plurality of controllably variable amplitude controlling means, for exciting said plurality of element antennas.

6. A method for determining the excitation amplitude and excitation phase for exciting each of a plurality of element antennas of an antenna system comprising the steps of:

determining the excitation amplitude and the excitation phase so that the antenna gain $G_j$ (j=1 to J) (J is the total number of evaluation points) at the jth evaluation point approaches a desired antenna gain $G_{oj}$; establishing an allowable variation width for the excitation amplitude; keeping the excitation amplitude in the allowable variation width; fixing the excitation amplitude kept in the allowable variation width range; and repeating said determining step so that the antenna gain $G_j$ (j=1 to J) at the jth evaluation point becomes closer to the desired gain $G_{oj}$ by only the effect of the excitation phase.

7. A method for determining an excitation amplitude and phase used to define a desired radiation pattern composed by each of a plurality of element antennas of an antenna system with respect to a preset allowable variation width D of the excitation amplitude comprising the steps of:

(a) calculating the antenna gain $G_j$ (j=1 to J) in accordance with the following equation:

$$G_j = \sum_{i=1}^{I} (A_i \cdot P_{ij})^* \cdot (A_i \cdot P_{ij})/(A_i^* \cdot A_i)$$

where

J = total number of inputted evaluation points

I = total number of elements antennas $P_{ij}$ = patterns of array elements $A_i$ = initial excitation amplitude and phase i=1 to I j=1 to J

* = complex conjugate;

(b) determining the combination or set of values of $A_i$ (i=1 to I) which provides a solution for minimizing an evaluation function F represented by the following equation:

$$F = \sum_{j=1}^{J} W_j \, |G_j - G_{oj}|^2$$

where $G_j$ (j=1 to J)=antenna gain obtained in accordance with the equation represented by said step (a)

$G_{oj}$=inputted desired antenna gain $W_j$=weighting factor j=1 to J;

(c) standardizing the excitation amplitude $a_i$ with the maximum value M provided that $a_i=|A_i|$, M=Max. $a_i$ (i=1 to I) in the set of the values of $A_i$ obtained from the above step (b) to thereby replace the value of the excitation amplitude $a_i$, which is defined to make the value thus standardized below the allowable variation width D of the excitation amplitude, by M•D;

(d) fixing all the excitation amplitude $a_i$ (i=1 to I) obtained from the above so as to determine the set of the excitation phase $p_i$ (i=1 to I), which provides a solution for minimizing the evaluation function F represented by the following equation:

$$F = \sum_{j=1}^{J} W_j \, |G_j - G_{oj}|^2$$

where $p_i = \tan^{-1} I_A i / R_A i$ $R_A i$=real part of $A_i$ $I_A i$=imaginary part of $A_i$;

(e) calculating $G_j$ (j=1 to I) with respect to the set of the values of $A_i$ (i=1 to I) obtained from $a_i$ and $p_i$ determined from the above, in accordance with the following equation:

$$G_j = \sum_{i=1}^{I} (A_i \cdot P_{ij})^* \cdot (A_i \cdot P_{ij}) / (A_i^* \cdot A_i)$$

where the asterisk * represents the complex conjugate;

(f) regarding $a_i$, $p_i$ (i=1 to I) thus obtained as being desired excitation amplitude and phase, respectively. determining whether all $G_j$ obtained from the equation in said step (e) exceeds a desired antenna gain $G_{oj}$ (j=1 to J), and if so terminating the method, otherwise determining on an advance to the following step; and (g) determining whether or not each $G_j$ is greater than the corresponding $G_{oj}$ in response to the determination that all $G_j$ has been below the desired antenna gain $G_{oj}$, and setting $W_j$ such that if $G_j \geqq F_{oj}$, then $W_j=0$ and if $G_j < G_{oj}$, then $W_j=1$ (j=1 to J), and utilizing $A_i$ (i=1 to I) obtained from the above step (b) as the initial excitation amplitude and phase and then returning again to the above step (a).

8. An antenna system comprising:

a plurality of element antennas;

a plurality of variable phase shifters and a plurality of variable amplitude type device connected to said plurality of element antennas respectively; and an arithmetic unit used to determine the excitation amplitude and the excitation phase for exciting each of said plurality of element antennas, wherein said arithmetic unit comprises first means for determining the excitation amplitude and the excitation phase so that the antenna gain $G_j$ (j=1 to J) (J is the total number of evaluation points) at the jth evaluation point approaches a desired antenna gain $G_{oj}$, means for establishing an allowable variation width for the excitation amplitude, second means responsive to said establishing means for determining whether the excitation amplitude falls within the allowable variation width, and means responsive to said second determining means for again determining the excitation amplitude and the excitation phase such that the antenna gain $G_j$ (j=1 to J) at the jth evaluation point becomes closer to the desired gain $G_{oj}$ by only the effect of the excitation phase.

9. An antenna system as recited in claim 8, further comprising:

excitation means for exciting said plurality of element antennas, wherein said plurality of variable phase shifters and said plurality of variable amplitude type devices together are operatively interposed between said excitation means and said plurality of element antennas.

10. An antenna system, comprising:

a plurality of element antennas;

a like plurality of controllably variable phase shift means, each connected to a respective one of said element antennas, for respectively controlling excitation phase for said element antennas;

a like plurality of controllably variable amplitude controlling means, each connected to a respective one of said variable phase shift means, for respectively controlling excitation amplitude for said element antennas; and control means connected to control each of said variable phase shift means and to control each of said variable amplitude controlling means, said control means including means for establishing a predetermined allowable variation range of the excitation amplitude, means responsive to said establishing means for adjusting the excitation amplitude to be within the predetermined allowable variation range, and means responsive to said adjusting means for independently controlling said variable phase shift means and said variable amplitude controlling means.

11. An antenna system as cited in claim 10 wherein said adjusting means comprises:

first means for determining the excitation amplitude and the excitation phase so that the antenna gain $G_j$ (j=1 to J) (J is the total number of evaluation points) at the jth evaluation point approaches a desired antenna gain $G_{oj}$;

second means responsive to said establishing means for determining whether the excitation amplitude falls within the predetermined allowable variation range; and means responsive to said second determining means for again determining the excitation amplitude and the excitation phase such that the antenna gain $G_j$ (j=1 to J) at the jth evaluation point becomes closer to the desired gain $G_{oj}$ by only the effect of the excitation phase.

12. An antenna system as recited in claim 10, further comprising:

means, connected to said plurality of controllably variable amplitude controlling means, for exciting said plurality of element antennas.

13. A method for determining the individual excitation amplitude and individual excitation phase for exciting each of a plurality of element antennas of an antenna system, comprising the steps of:

determining the excitation amplitude and the excitation phase sop that the antenna gain $G_j$ (j=1 to J) (J is the total number of evaluation points) at the jth evaluation point approaches a desired antenna gain $G_{oj}$;

establishing an allowable variation width range for the excitation amplitude;

determining whether the excitation amplitude falls within the allowable variation width range; and again determining the excitation amplitude and the excitation phase such that the antenna gain $G_j$ (j=1 to J) at the jth evaluation point becomes closer to the desired gain $G_{oj}$ by only the effect of the excitation phase.

* * * * *